US008550346B2

(12) United States Patent
Liu et al.

(10) Patent No.: US 8,550,346 B2
(45) Date of Patent: Oct. 8, 2013

(54) LOW-ALTITUDE LOW-SPEED SMALL TARGET INTERCEPTING METHOD

(71) Applicant: Beijing Mechanical Equipment Institute, Beijing (CN)

(72) Inventors: Hao Liu, Beijing (CN); Shengjie Wang, Beijing (CN); Xuchang Ding, Beijing (CN); Xiaoming Wei, Beijing (CN); Shuyong Han, Beijing (CN); Xuyang Qiu, Beijing (CN); Kegang Chi, Beijing (CN); Yan Shen, Beijing (CN); Aifeng Chen, Beijing (CN); Yulong Tang, Beijing (CN)

(73) Assignee: Beijing Mechanical Equipment Institute, Beijing (CN)

( * ) Notice: Subject to any disclaimer, the term of this patent is extended or adjusted under 35 U.S.C. 154(b) by 0 days.

(21) Appl. No.: 13/851,101

(22) Filed: Mar. 27, 2013

(65) Prior Publication Data

US 2013/0214045 A1 Aug. 22, 2013

Related U.S. Application Data

(63) Continuation of application No. PCT/CN2011/076629, filed on Jun. 30, 2011.

(51) Int. Cl.
*G06F 19/00* (2011.01)

(52) U.S. Cl.
USPC ..... 235/411; 235/404; 235/407

(58) Field of Classification Search
USPC ..... 235/404, 407, 411
See application file for complete search history.

(56) References Cited

U.S. PATENT DOCUMENTS

| | | | |
|---|---|---|---|
| 5,583,311 | A | 12/1996 | Rieger |
| 6,626,077 | B1 | 9/2003 | Gilbert |

FOREIGN PATENT DOCUMENTS

| | | | |
|---|---|---|---|
| CN | 85106886 | A | 3/1987 |
| CN | 1527020 | A | 9/2004 |
| CN | 101392999 | A | 3/2009 |
| CN | 101982720 | A | 3/2011 |
| WO | 2006/079029 | A2 | 7/2006 |
| WO | 2008/029392 | A2 | 3/2008 |
| WO | 2009/1045573 | A1 | 4/2009 |

OTHER PUBLICATIONS

First Office Action indicating allowance in CN Patent Application No. 2010295487.2; mailed Aug. 28, 2012.
Written Opinion of the International Searching Authority in PCT/CN2011/076629.

*Primary Examiner* — Kristy A Haupt
(74) *Attorney, Agent, or Firm* — Syncoda LLC; Feng Ma

(57) ABSTRACT

Systems and methods allow for intercepting a small, low-altitude and low-velocity target. A system includes a detecting apparatus, a directing control apparatus, an aiming control apparatus, a launch control apparatus, a launching device, and an intercepting device. A method includes: searching and tracking a target by the detecting apparatus in a networking mode, or by the aiming control apparatus in a single-soldier mode; sending target information to the launch control apparatus; performing a trajectory calculation by the launch control apparatus; and launching the intercepting device by the launching device to intercept the target. A low-cost system with a short response time can thus be realized. The target falls with the net at a low velocity under a parachute, and this is desirable in a city environment.

1 Claim, No Drawings

LOW-ALTITUDE LOW-SPEED SMALL TARGET INTERCEPTING METHOD

CROSS-REFERENCE TO RELATED APPLICATIONS

The present application is a continuation of PCT/CN2011/076629, filed Jun. 30, 2011, which claims priority to Chinese Patent Application No. 201010295487.2, filed Sep. 29, 2010, now Chinese Patent No. 201010295487.2. The disclosures of these references are hereby incorporated by reference in their entirety.

FIELD

The present disclosure relates to a method for intercepting a target in airspace, and more particularly to a method for intercepting a small target with low altitude and low velocity.

BACKGROUND

For large-scale gathering or activities in cities, one main security mission is to prevent destruction from terrorists or hostiles using small aircrafts with low altitude and low velocity (such as, model aircrafts, balloons). In order to intercept a small target with low altitude and low velocity, a conventional destructive weapon (such as, an antiaircraft weapon, a firearm) is not recommended to use because of particularities of a city environment and the large-scale activity, and thus a nondestructive intercepting mode is introduced instead.

Currently domestically and abroad, a type of nondestructive weapon is a net catching system, which is directed against ground target. A "net gun," which makes use of high pressure gas or blank as power to throw out and unfold a catching net in order to capture a criminal, is primarily used domestically to intercept the target. A "КОБ А" system (Ukraine), which may launch the catching net from a relatively distant location to capture the ground target, is primarily used abroad to intercept the target. Both methods mentioned above, which are nondestructive net intercepting mode, are used for catching the ground target but are incapable for an aerial target.

SUMMARY

Systems and methods are provided for intercepting a small target with low altitude and low velocity to solve a problem that a conventional method for catching a ground target is incapable of catching an aerial target.

The method for intercepting a small target with low altitude and low velocity by a system, in which the system comprises: a detecting apparatus, a directing control apparatus, an aiming control apparatus, a launch control apparatus, a launching device and an intercepting device. The method comprises steps of:

step 1, detecting a target, comprising:

for a single-soldier mode, when a small target with low altitude and low velocity is observed by a visual measurement of an operator, tracking the small target with low altitude and low velocity by an aiming device of the aiming control apparatus, and real time measuring target parameters including an orientation, a height and a velocity by laser ranging;

for a networking mode, searching an airspace and identifying a target with the detecting apparatus, when the small target with low altitude and low velocity is identified, tracking the small target with low altitude and low velocity, and real time measuring the target parameters including the orientation, the height and the velocity by laser ranging;

step 2, calculating a trajectory and aiming at the target, comprising:

for the single-soldier mode, performing a trajectory calculation by the launch control apparatus according to the target parameters, the operator aiming at the target with a shooting initialization point indicated by the aiming control apparatus subsequent to a successful trajectory calculation; for the networking mode, the directing control apparatus processing target information provided by the detecting apparatus and then sending to the launch control apparatus, real time performing a trajectory calculation by the launch control apparatus, and controlling a corresponding launching device to real time aim at the target; and formulas for the trajectory calculation being as:

$$\begin{aligned} x_1 &= l_1\cos\alpha_1\cos\theta_1 \\ y_1 &= l_1\sin\alpha_1 \\ z_1 &= l_1\cos\alpha_1\sin\theta_1 \\ x_2 &= l_2\cos\alpha_2\cos\theta_2 \\ y_2 &= l_2\sin\alpha_2 \\ z_2 &= l_2\cos\alpha_2\sin\theta_2 \end{aligned} \tag{1}$$

$$\vec{v} = \frac{x_1 - x_2}{\Delta t}\vec{i}\,\frac{y_1 - y_2}{\Delta t}\vec{j}\,\frac{z_1 - z_2}{\Delta t}\vec{k} \tag{2}$$

$$\vec{v} = \frac{l_1\cos\alpha_1\cos\theta_1 - l_2\cos\alpha_2\cos\theta_2}{\Delta t}\vec{i} + \frac{l_1\sin\alpha_1 - l_2\sin\alpha_2}{\Delta t}\vec{j} + \frac{l_1\cos\alpha_1\sin\theta_1 - l_2\cos\alpha_2\sin\theta_2}{\Delta t}\vec{k} \tag{3}$$

$$x_0 = l_1\cos\alpha_1\cos\theta_1 + \frac{l_1\cos\alpha_1\cos\theta_1 - l_2\cos\alpha_2\cos\theta_2}{\Delta t}t_0 \tag{4}$$

$$y_0 = l_1\sin\alpha_1 + \frac{l_1\sin\alpha_1 - l_2\sin\alpha_2}{\Delta t}t_0 \tag{5}$$

$$z_0 = l_1\cos\alpha_1\sin\theta_1 + \frac{l_1\cos\alpha_1\sin\theta_1 - l_2\cos\alpha_2\sin\theta_2}{\Delta t}t_0 \tag{6}$$

$$v_x = \frac{l_1\cos\alpha_1\cos\theta_1 - l_2\cos\alpha_2\cos\theta_2}{\Delta t} \tag{7}$$

$$v_y = \frac{l_1\sin\alpha_1 - l_2\sin\alpha_2}{\Delta t} \tag{8}$$

$$v_z = \frac{l_1\cos\alpha_1\sin\theta_1 - l_2\cos\alpha_2\sin\theta_2}{\Delta t} \tag{9}$$

$$\begin{cases} d^2 = x_0^2 + y_0^2 + z_0^2 \\ x_0 = l_1\cos\alpha_1\cos\theta_1 + v_x t_0 \\ y_0 = l_1\sin\alpha_1 + v_y t_0 \\ z_0 = l_1\cos\alpha_1\sin\theta_1 + v_z t_0 \end{cases} \tag{10}$$

where $l_1$ is a slant range of a target point A;

$\theta_1$ is an azimuth angle of the target point A;

$\alpha_1$ is an angular altitude of the target point A;

$l_2$ is a slant range of a target point B;

$\theta_2$ is an azimuth angle of the target point B;

$\alpha_2$ is an angular altitude of the target point B;

$\vec{v}$ is a target velocity vector;

$t_0$ is a time of a target craft from the point A to an intercepting point;

d is a slant range of the target craft at the point B to the intercepting device;

$(x_0, y_0, z_0)$ is a coordinate of the intercepting point;

$\Delta t$ is a time of the target craft flying from the point A to the point B;

step 3, loading parameters and launching the intercepting device, comprising:

subsequent to the trajectory calculation completed by the launch control apparatus, calculating a net-opening time, loading the net-opening time to the intercepting device, and launching the intercepting device by the launching device;

step 4, projecting an intercepting net to intercept the target, comprising:

after being launched to the airspace, the intercepting device flying along a predetermined trajectory and projecting the intercepting net until the intercepting device arrives at a target position, the intercepting net flying to the target, coming into contact with and enwinding the target to make the target fall due to its loss of power.

step 5, opening a parachute to fall with a remaining load, comprising:

opening the parachute by the intercepting device, and the parachute with the remaining load falling to a ground at a velocity ranging from 4 m/s to 8 m/s.

Up to now, the interception of the small target with low altitude and low velocity is completed.

With the method according to embodiments of the present disclosure, the intercepting device launched from the ground is used to catch an aerial target. The method has advantages of low cost, short response time, the remaining load falling in a low velocity, which is applicable for a city environment.

DETAILED DESCRIPTION

Embodiment 1

In a single-soldier mode, a method for intercepting a small target with low altitude and low velocity is realized by a system comprising: an aiming control apparatus, a launch control apparatus, a launching device and an intercepting device.

In the single-soldier mode, the method comprises the following steps.

In step 1, a target is detected.

Specifically, a target is searched and tracked by an operator using the aiming control apparatus, and then target parameters including such as an orientation, a height and a velocity are measured in real time by laser ranging.

In step 2, a trajectory is calculated and the target is aimed at.

Specifically, a trajectory calculation is performed by the launch control apparatus according to the target parameters, and the operator aims at the target with a shooting initialization point indicated by the aiming control apparatus subsequent to a successful trajectory calculation. Formulas for the trajectory calculation are as follows:

$$\begin{aligned} x_1 &= l_1\cos\alpha_1\cos\theta_1 \\ y_1 &= l_1\sin\alpha_1 \\ z_1 &= l_1\cos\alpha_1\sin\theta_1 \\ x_2 &= l_2\cos\alpha_2\cos\theta_2 \\ y_2 &= l_2\sin\alpha_2 \\ z_2 &= l_2\cos\alpha_2\sin\theta_2 \end{aligned} \tag{1}$$

$$\vec{v} = \frac{x_1 - x_2}{\Delta t}\vec{i}\,\frac{y_1 - y_2}{\Delta t}\vec{j}\,\frac{z_1 - z_2}{\Delta t}\vec{k} \tag{2}$$

$$\vec{v} = \frac{l_1\cos\alpha_1\cos\theta_1 - l_2\cos\alpha_2\cos\theta_2}{\Delta t}\vec{i} + \frac{l_1\sin\alpha_1 - l_2\sin\alpha_2}{\Delta t}\vec{j} + \frac{l_1\cos\alpha_1\sin\theta_1 - l_2\cos\alpha_2\sin\theta_2}{\Delta t}\vec{k} \tag{3}$$

-continued $$x_0 = l_1\cos\alpha_1\cos\theta_1 + \frac{l_1\cos\alpha_1\cos\theta_1 - l_2\cos\alpha_2\cos\theta_2}{\Delta t}t_0 \tag{4}$$

$$y_0 = l_1\sin\alpha_1 + \frac{l_1\sin\alpha_1 - l_2\sin\alpha_2}{\Delta t}t_0 \tag{5}$$

$$z_0 = l_1\cos\alpha_1\sin\theta_1 + \frac{l_1\cos\alpha_1\sin\theta_1 - l_2\cos\alpha_2\sin\theta_2}{\Delta t}t_0 \tag{6}$$

$$v_x = \frac{l_1\cos\alpha_1\cos\theta_1 - l_2\cos\alpha_2\cos\theta_2}{\Delta t} \tag{7}$$

$$v_y = \frac{l_1\sin\alpha_1 - l_2\sin\alpha_2}{\Delta t} \tag{8}$$

$$v_z = \frac{l_1\cos\alpha_1\sin\theta_1 - l_2\cos\alpha_2\sin\theta_2}{\Delta t} \tag{9}$$

$$\begin{cases} d^2 = x_0^2 + y_0^2 + z_0^2 \\ x_0 = l_1\cos\alpha_1\cos\theta_1 + v_x t_0 \\ y_0 = l_1\sin\alpha_1 + v_y t_0 \\ z_0 = l_1\cos\alpha_1\sin\theta_1 + v_z t_0 \end{cases} \tag{10}$$

where $l_1$ is a slant range of a target point A;

$\theta_1$ is an azimuth angle of the target point A;

$\alpha_1$ is an angular altitude of the target point A;

$l_2$ is a slant range of a target point B;

$\theta_2$ is an azimuth angle of the target point B;

$\alpha_2$ is an angular altitude of the target point B;

$\vec{v}$ is a target velocity vector;

$t_0$ is a time of a target craft from the point A to an intercepting point;

d is a slant range of the target craft at the point B to the intercepting device;

$(x_0, y_0, z_0)$ is a coordinate of the intercepting point;

$\Delta t$ is a time of the target craft flying from the point A to the point B;

At is a time of the target craft flying from the point A to the point B.

In step 3, parameters are loaded and the intercepting device is launched.

Specifically, subsequent to the trajectory calculation completed by the launch control apparatus, a net-opening time is calculated and loaded to the intercepting device, and the intercepting device is launched by the launching device.

In step 4, an intercepting net is projected to intercept the target.

Specifically, after being launched to the airspace, the intercepting device flies along a predetermined trajectory and projects the intercepting net until it arrives at a target position. The intercepting net flies to, contacts and enwinds the target to make the target fall due to its loss of power.

In step 5, a parachute is opened to fall with a remaining load.

Specifically, the parachute is opened by the intercepting device, and the parachute with the remaining load falls to a ground at a velocity of about 4 m/s to about 8 m/s.

Up to now, the interception of the small target with low altitude and low velocity in the single-soldier mode is completed.

Embodiment 2

In a networking mode, a method for intercepting a small target with low altitude and low velocity is realized by a system comprising: a detecting apparatus, a directing control apparatus, a launch control apparatus, a launching device and an intercepting device.

In the networking mode, the method comprises the following steps.

In step 1, a target is detected.

Specifically, an airspace is searched and a target is identified by the detecting apparatus. When the small target with low altitude and low velocity is identified, the small target with low altitude and low velocity is tracked, and the target parameters including the orientation, the height and the velocity are real time measured by laser ranging.

In step 2, a trajectory is calculated and the target is aimed at.

Specifically, target information provided by the detecting apparatus is processed by the directing control apparatus and then is sent to the launch control apparatus. A trajectory calculation is real time performed by the launch control apparatus, and a corresponding launching device is controlled to real time aim at the target. Formulas for the trajectory calculation are as follows:

$$\begin{aligned} x_1 &= l_1\cos\alpha_1\cos\theta_1 \\ y_1 &= l_1\sin\alpha_1 \\ z_1 &= l_1\cos\alpha_1\sin\theta_1 \\ x_2 &= l_2\cos\alpha_2\cos\theta_2 \\ y_2 &= l_2\sin\alpha_2 \\ z_2 &= l_2\cos\alpha_2\sin\theta_2 \end{aligned} \tag{1}$$

$$\vec{v} = \frac{x_1 - x_2}{\Delta t}\vec{i}\,\frac{y_1 - y_2}{\Delta t}\vec{j}\,\frac{z_1 - z_2}{\Delta t}\vec{k} \tag{2}$$

$$\vec{v} = \frac{l_1\cos\alpha_1\cos\theta_1 - l_2\cos\alpha_2\cos\theta_2}{\Delta t}\vec{i} + \frac{l_1\sin\alpha_1 - l_2\sin\alpha_2}{\Delta t}\vec{j} + \frac{l_1\cos\alpha_1\sin\theta_1 - l_2\cos\alpha_2\sin\theta_2}{\Delta t}\vec{k} \tag{3}$$

$$x_0 = l_1\cos\alpha_1\cos\theta_1 + \frac{l_1\cos\alpha_1\cos\theta_1 - l_2\cos\alpha_2\cos\theta_2}{\Delta t}t_0 \tag{4}$$

$$y_0 = l_1\sin\alpha_1 + \frac{l_1\sin\alpha_1 - l_2\sin\alpha_2}{\Delta t}t_0 \tag{5}$$

$$z_0 = l_1\cos\alpha_1\sin\theta_1 + \frac{l_1\cos\alpha_1\sin\theta_1 - l_2\cos\alpha_2\sin\theta_2}{\Delta t}t_0 \tag{6}$$

$$v_x = \frac{l_1\cos\alpha_1\cos\theta_1 - l_2\cos\alpha_2\cos\theta_2}{\Delta t} \tag{7}$$

$$v_y = \frac{l_1\sin\alpha_1 - l_2\sin\alpha_2}{\Delta t} \tag{8}$$

$$v_z = \frac{l_1\cos\alpha_1\sin\theta_1 - l_2\cos\alpha_2\sin\theta_2}{\Delta t} \tag{9}$$

$$\begin{cases} d^2 = x_0^2 + y_0^2 + z_0^2 \\ x_0 = l_1\cos\alpha_1\cos\theta_1 + v_x t_0 \\ y_0 = l_1\sin\alpha_1 + v_y t_0 \\ z_0 = l_1\cos\alpha_1\sin\theta_1 + v_z t_0 \end{cases} \tag{10}$$

where $l_1$ is a slant range of a target point A;

$\theta_1$ is an azimuth angle of the target point A;

$\alpha_1$ is an angular altitude of the target point A;

$l_2$ is a slant range of a target point B;

$\theta_2$ is an azimuth angle of the target point B;

$\alpha_2$ is an angular altitude of the target point B;

$\vec{v}$ is a target velocity vector;

$t_0$ is a time of a target craft from the point A to an intercepting point;

d is a slant range of the target craft at the point B to the intercepting device;

$(x_0, y_0, z_0)$ is a coordinate of the intercepting point;

$\Delta t$ is a time of the target craft flying from the point A to the point B;

In step 3, parameters are loaded and the intercepting device is launched.

Specifically, when the trajectory calculation succeeds, a net-opening time is calculated by the launch control apparatus and then is loaded to the intercepting device, and the intercepting device is launched.

In step 4, an intercepting net is projected to intercept the target.

Specifically, after being launched to the airspace, the intercepting device flies along a predetermined trajectory and projects the intercepting net until it arrives at a target position. The intercepting net flies to, contacts and enwinds the target to make the target falling due to loss of power.

In step 5, a parachute is opened to fall with a remaining load.

Specifically, the parachute is opened by the intercepting device, and the parachute with the remaining load falls to a ground in a velocity of about, for example, 6 m/s.

Up to now, the interception of the small target with low altitude and low velocity in the networking mode is completed.

The invention claimed is:

1. A method for intercepting a small target with low altitude and low velocity by a system, wherein the system comprises: a detecting apparatus, a directing control apparatus, an aiming control apparatus, a launch control apparatus, a launching device and an intercepting device, and the method comprises steps of:

step 1, detecting a target, comprising:

for a single-soldier mode, when a small target with low altitude and low velocity is observed by a visual measurement of an operator, tracking the small target with low altitude and low velocity by an aiming device of the aiming control apparatus, and real time measuring target parameters including an orientation, a height and a velocity by laser ranging;

for a networking mode, searching an airspace and identifying a target with the detecting apparatus, when the small target with low altitude and low velocity is identified, tracking the small target with low altitude and low velocity, and real time measuring the target parameters including the orientation, the height and the velocity by laser ranging;

step 2, calculating a trajectory and aiming at the target, comprising:

for the single-soldier mode, performing a trajectory calculation by the launch control apparatus according to the target parameters, the operator aiming at the target with a shooting initialization point indicated by the aiming control apparatus subsequent to a successful trajectory calculation; for the networking mode, the directing control apparatus processing target information provided by the detecting apparatus and then sending to the launch control apparatus, real time performing a trajectory calculation by the launch control apparatus, and controlling a corresponding launching device to real time aim at the target;

and formulas for the trajectory calculation as:

$$x_1 = l_1\cos\alpha_1\cos\theta_1 \quad (1)$$
$$y_1 = l_1\sin\alpha_1$$
$$z_1 = l_1\cos\alpha_1\sin\theta_1$$
$$x_2 = l_2\cos\alpha_2\cos\theta_2$$
$$y_2 = l_2\sin\alpha_2$$
$$z_2 = l_2\cos\alpha_2\sin\theta_2$$

$$\vec{v} = \frac{x_1 - x_2}{\Delta t}\vec{i}\,\frac{y_1 - y_2}{\Delta t}\vec{j}\,\frac{z_1 - z_2}{\Delta t}\vec{k} \quad (2)$$

$$\vec{v} = \frac{l_1\cos\alpha_1\cos\theta_1 - l_2\cos\alpha_2\cos\theta_2}{\Delta t}\vec{i} + \frac{l_1\sin\alpha_1 - l_2\sin\alpha_2}{\Delta t}\vec{j} + \frac{l_1\cos\alpha_1\sin\theta_1 - l_2\cos\alpha_2\sin\theta_2}{\Delta t}\vec{k} \quad (3)$$

$$x_0 = l_1\cos\alpha_1\cos\theta_1 + \frac{l_1\cos\alpha_1\cos\theta_1 - l_2\cos\alpha_2\cos\theta_2}{\Delta t}t_0 \quad (4)$$

$$y_0 = l_1\sin\alpha_1 + \frac{l_1\sin\alpha_1 - l_2\sin\alpha_2}{\Delta t}t_0 \quad (5)$$

$$z_0 = l_1\cos\alpha_1\sin\theta_1 + \frac{l_1\cos\alpha_1\sin\theta_1 - l_2\cos\alpha_2\sin\theta_2}{\Delta t}t_0 \quad (6)$$

$$v_x = \frac{l_1\cos\alpha_1\cos\theta_1 - l_2\cos\alpha_2\cos\theta_2}{\Delta t} \quad (7)$$

$$v_y = \frac{l_1\sin\alpha_1 - l_2\sin\alpha_2}{\Delta t} \quad (8)$$

$$v_z = \frac{l_1\cos\alpha_1\sin\theta_1 - l_2\cos\alpha_2\sin\theta_2}{\Delta t} \quad (9)$$

$$\begin{cases} d^2 = x_0^2 + y_0^2 + z_0^2 \\ x_0 = l_1\cos\alpha_1\cos\theta_1 + v_x t_0 \\ y_0 = l_1\sin\alpha_1 + v_y t_0 \\ z_0 = l_1\cos\alpha_1\sin\theta_1 + v_z t_0 \end{cases} \quad (10)$$

where $l_1$ is a slant range of a target point A;

$\theta_1$ is an azimuth angle of the target point A;

$\alpha_1$ is an angular altitude of the target point A;

$l_2$ is a slant range of a target point B;

$\theta_2$ is an azimuth angle of the target point B;

$\alpha_2$ is an angular altitude of the target point B;

$\vec{v}$ is a target velocity vector;

$t_0$ is a time of a target craft from the point A to an intercepting point;

d is a slant range of the target craft at the point B to the intercepting device;

$(x_0, y_0, z_0)$ is a coordinate of the intercepting point;

$\Delta t$ is a time of the target craft flying from the point A to the point B;

step 3, binding a result and launching the intercepting device, comprising:

subsequent to the trajectory calculation completed by the launch control apparatus, calculating a start time, binding the start time to the intercepting device, and launching the intercepting device by the launching device;

step 4, projecting an intercepting net to intercept the target, comprising:

after being launched to the airspace, the intercepting device flying along a predetermined trajectory and projecting the intercepting net until the intercepting device arrives at a target position, the intercepting net flying to the target, touching and enwinding the target to make the target fall due to loss of power;

step 5, opening a parachute to fall with a remaining load, comprising:

opening the parachute by the intercepting device, and the parachute with the remaining load falling to a ground in a velocity ranging from 4 m/s to 8 m/s.

* * * * *